US005100705A

United States Patent [19]

Yamane et al.

[11] Patent Number: 5,100,705

[45] Date of Patent: * Mar. 31, 1992

[54] METHOD FOR COATING AND ASSEMBLING SUBSTRATES OF DIFFERENT CHARACTERTISTICS INTO AN INTEGRAL BODY HAVING SUBSTANTAILLY CONSISTENT GLOSS CHARACTERISTICS

[75] Inventors: Takakazu Yamane; Tadamitsu Nakahama; Yoshio Tanimoto; Toshifumi Ogasawara, all of Hiroshima, Japan

[73] Assignee: Mazda Motor Corporation, Hiroshima, Japan

[ * ] Notice: The portion of the term of this patent subsequent to Oct. 17, 2006 has been disclaimed.

[21] Appl. No.: 429,057

[22] Filed: Oct. 30, 1989

[30] Foreign Application Priority Data

Oct. 31, 1988 [JP] Japan ..... 63-275031
Sep. 22, 1989 [JP] Japan ..... 1-247692

[51] Int. Cl.[5] ..... B05D 1/02

[52] U.S. Cl. ..... 427/425; 427/240; 427/346

[58] Field of Search ..... 427/425, 240, 346

[56] References Cited

U.S. PATENT DOCUMENTS 4,611,380 9/1986 Abe et al. ..... 118/697 X
4,874,639 10/1989 Matsui et al. ..... 427/425 X
4,919,977 4/1990 Yamane et al. ..... 427/425 X

*Primary Examiner*—Shrive Beck
*Assistant Examiner*—Alain Bashore
*Attorney, Agent, or Firm*—Fish & Richardson

[57] ABSTRACT

In a coating, line a first substrate such as a vehicle body, made of a steel plate, is coated separately from a second substrate made of a different material including a plastic, such as vehicle parts, i.e., bumpers and so on, and the parts are assembled with the vehicle body. The vehicle body and parts are coated separately to form each a highly reflective surface coating. The coating is implemented by a spraying step for spraying the paint on them to form a coat; and a drying step for drying the coat. The paint is sprayed in the spraying step in a film thickness which is thicker than a thickness at which the paint sags on a surface extending at least upwardly and downwardly. And the coat on each of the substrates is dried in the drying step while being rotated about its horizontal axis for a period of time ranging at least from before the paint starts sagging to until the paint achieves a substantially sagless state, rotation of the substrate being carried out at a speed which is high enough to rotate the substrate from a vertical position to a horizontal position before the paint coated thereon substantially sages due to gravity yet which is low enough so as to cause no sagging as a result of centrifugal force.

36 Claims, 8 Drawing Sheets

FOR STEEL BODY (65μm THICK)
TWO-LIQ URETHANE (65μm THICK)
ONE-LIQ URETHANE (65μm THICK)
SAGGING VELOCITY (mm/min)
13
12
11
10
9
8
7
6
5
4
3
2
1
0
SETTING
BAKING
0 1 2 3 4 5 6 7 8 9 10
0 1 2 3 4 5 6 7 8

METHOD FOR COATING AND ASSEMBLING SUBSTRATES OF DIFFERENT CHARACTERTISTICS INTO AN INTEGRAL BODY HAVING SUBSTANTAILLY CONSISTENT GLOSS CHARACTERISTICS

BACKGROUND OF THE INVENTION

1. Field of the Invention

The present invention relates to a coating method.

2. Description of Related Art

A coating method for coating an outer surface of a substrate such as a vehicle body generally includes a preparation step for preparing for the substrate to be coated with a paint by removing dust or other foreign materials from the substrate, a coating step for spraying the substrate with the paint, and a drying step for drying the coat thereon. The drying step generally comprises sequential setting and baking steps in particular when a thermosetting paint is used. The setting step is usually carried out prior to the baking step at an ambient temperature which is lower than the ambient temperature during the baking step, for example, at room temperature or at temperatures ranging from 40° C. to 60° C., in order to volatilize a solvent slowly so as to prevent a formation of pinholes on the coat surface during the baking step which is usually carried out at approximately 140° C.

The substrate is held at a given position on a conveyance means such as a carriage while being conveyed during the preparation, coating, and drying steps.

A degree of flatness or smoothness on the surface of a coat on the substrate is one of standards for evaluating a quality of the coat. The higher a degree of flatness the smaller a degree of irregularities on the coat surface, thus producing a better coat. It is well known that a thicker film thickness of a paint may give a higher degree of flatness on a coat surface. A paint sprayed on the surface of a substrate may be said to sag when it is visually observed that the paint sprayed thereon flows and finds a trace of movement on the coat by 1 mm to 2 mm from a site where the paint was sprayed until it is cured in the drying step. It may be defined herein that a sag of the paint occurs if such a trace exceeds at least 2 mm when visually observed. In other words, a sagging limit thickness of a paint is a film thickness beyond the maximum film thickness at which the paint does not sag at least in the drying step if it is left as it was sprayed. Thus, a film thickness of the paint within its sagging limit thickness is a film thickness in which it it does not sag in the drying step even if it is left as it was sprayed. On the contrary, a film thickness thicker than its sagging limit thickness of the paint is a film thickness at which the paint causes sagging at least during the drying step when it is stayed as it was sprayed.

The paint causes sagging when the paint coated thereon flow downwardly due to gravity. The paint becomes more likely to cause sagging as a film thickness of the paint sprayed gets thicker. Thus it is a matter of course that the paint sags more likely on a surface of the substrate extending in an up-and-downward direction, i.e., a vertically extending surface, than on a surface thereof extending in a horizontal direction, i.e., a horizontally extending surface. This enables the paint to be coated on the horizontally extending surface in a film thickness thicker than on the vertically extending surface because the sags or drips of the paint little affect adversely the coat sprayed on the horizontally extending surface of the substrate. If the film thickness of a coat on the horizontally extending surface is the same as that on the vertically extending surface, the former can produce a coat with a degree of flatness higher than the latter because the paint sprayed on the horizontally extending surface becomes flattened due to a natural flow in the paint to an extent to which no sags substantially occur.

Conventionally, in order to provide a coat with a higher degree of flatness while preventing sags or drips of a paint coated on a surface of the substrate, there have been used paints which are lower in viscosity and less flowable. Even if such a thermosetting paint is used, however, a sagging limit thickness of the paint sprayed on the vertically extending surface is as high as approximately 40 μm. This sagging limit thickness is the maximum film thickness in which the paint does not substantially sag on the vertically extending surface of a substrate. In other words, the paint is likely to sag or drip in initial stages of the setting and baking steps, particularly in the initial stage of the baking step. Accordingly, a film thickness of the coat is determined by a film thickness of the paint to be sprayed on the surface of a substrate to such an extent that the paint does not sag on its vertically extending surface. In order to produce a coat in a film thickness thicker than a sagging limit thickness of the paint, the spraying step is repeated twice or more in conventional coating method.

Furthermore, there is recently the increasing tendency that a plastic material has been used for bumpers and other parts of a vehicle, as an automobile. If such a plastic material is poor in a resistance to heat, when parts such as a bumper made out of the plastic material is coated and baked in a state in which they are assembled with a vehicle body, there is the risk that the bumper and other parts should transform due to high temperatures to be applied during the coating step. In order to avoid this, the bumpers and other parts are required to be coated and baked by themselves in such a state in which they are not mounted to the vehicle body and then they are to be mounted thereto after coating and baking.

Attempts have also been made to compete with the problem with spraying the paint in a film thickness thicker than its sagging limit thickness, and we have developed a technology that enables forming a coat having coat properties superior to coats obtainable by conventional coating methods, when sprayed in the same film thickness, as disclosed in our U.S. patent application Ser. No. 100,767. This technology involves spraying a vehicle body with the paint in a film thickness thicker than its sagging limit thickness and rotating the body about its substantially horizontal axis at least until the paint in the coat sprayed thereon is cured so as to cause no sagging any more. This coating method rather takes advantage of gravity that causes sags of the paint sprayed and the substrate is rotated so as to alter its direction in which gravity acts on the coat surface on the body, thereby preventing sags from occurring in the coat thereon while positively utilizing a flowability inherent in the paint and yielding a coat with a higher degree of flatness or smoothness than coats obtainable by conventional coating methods. Thus this technology is an excellent coating method in itself and provides a coating surface having a better degree of flatness or smoothness than the conventional coating method if the film thicknesses of the coats are the same.

When this technology is applied to coating of the bumpers and other parts of a vehicle body, it can provide a coat surface having a higher degree of gloss with a lesser number of coatings.

It is to be noted, however, that, even if a coat surface of the vehicle body would be superior to that obtainable by conventional coating methods yet the bumper and other parts which are to be mounted to the vehicle body would have a coat surface as good as those obtainable by conventional coating methods, the vehicle becomes rather poor in its appearance after assembly with the bumper and other parts because a difference of degrees of gloss between the vehicle body and bumper and other parts becomes too distinct. Furthermore, it should be noted that it is common that a paint to be used for coating the bumper or other parts is usually different from that to be used for the vehicle body, it is significantly difficult to match with coat surfaces between the vehicle body as well as the bumper and other parts and there may be the risk that an unharmonious and bad feeling resulting from a difference between materials and kinds of the paints would be produced and such a mismatch may be expanded.

SUMMARY OF THE INVENTION

Therefore, the present invention has the object to provide a coating method capable of causing no difference in degrees of gloss on coat surfaces between a substrate and another substrate which are different in materials when the substrate is assembled with the another substrate.

In order to achieve the object, the present invention consists of a coating method in a coating line for coating a first substrate and a second substrate of a different material with a paint separately to form each a highly reflective surface coating and assembling them into an integral body, comprising:

a spraying step for spraying the paint on each of the first and second substrates to form a coat; and a drying step for drying the coat;

wherein the paint is sprayed in the spraying step in a film thickness which is thicker than a thickness at which the paint sags on a surface extending at least upwardly and downwardly; and the coat on each of the substrates is dried in the drying step while being rotated about its horizontal axis for a period of time ranging at least from before the paint starts sagging to until the paint achieves a substantially sagless state, rotation of the substrate being carried out at a speed which is high enough to rotate the substrate from a vertical position to a horizontal position before the paint coated thereon substantially sags due to gravity yet which is low enough so as to cause no sagging as a result of centrifugal force.

Rotating the substrate on which the coat is formed in a substantially horizontal axis of the substrate changes the direction of the coat in which gravity acts, so that the coat can be dried without causing no sags.

This enables a film thickness of the coat to be formed by one shot of a coating operation to become thicker than conventional coating methods and furthermore provides a coat surface having a degree of flatness or smoothness higher than a level that is to be considered as a limit by the conventional methods. It is also to be noted that, when film thicknesses of the coats are the same, the coating method according to the present invention can provide a coat surface having a smaller degree of irregularity, i.e., a higher degree of flatness or smoothness, than the conventional methods. It is furthermore to be noted that, when a coat having a coat surface with a degree of flatness or smoothness as high as one obtainable by the conventional methods is sufficient, then the coating method according to the present invention can reduce a film thickness of the coat and thereby save an amount of the paint to be comsumed.

As have been described hereinabove, it is further to be understood that the paint is determined herein to sag when it is visually observed that the paint flows generally by approximately 2 mm if it is stayed as it was sprayed. Sags of the paint are left as marks on the coat surface in a string-like form when the paint is cured. Thus the spraying of the paint in a film thickness thicker than its sagging limit thickness results in the fact that the paint flows in a length longer than 2 mm when it is stayed untreated as it was sprayed. It is found as a matter of course that the higher a flowability of the paint the thinner its sagging limit thickness of the paint to be sprayed. In order to make a film thickness of a coat thicker than its sagging limit thickness, the paint may be sprayed once (as in a manner as called "one-stage spraying") or in two or more installments ("multi-stage spraying") to thereby provide a final film thickness so as to become thicker than the sagging limit thickness. It is also to be noted that the rotation of the substrate be carried out about its substantially horizontal axis in such a manner that the paint sprayed is not caused to move to a large extent due to gravity. The substrate may be rotated continuously or intermittently in one direction or in alternate directions until the paint gets cured and as a result becomes in a substantially sagless state. Furthermore, an angle at which the substrate is rotated about its horizontal axis is approximately 270 degrees because it is sufficient that a direction can be reversed, in which gravity acts upon a site sprayed with the paint in a film thickness above its sagging limit thickness. The axis about which the substrate is rotated may be inclined at approximately 30 degrees relative to the real horizontal axis thereof or may be pivoted.

The other objects and features of the present invention will become apparent in the course of the description of this specification.

DETAILED DESCRITPTION OF THE PREFERRED EMBODIMENTS

The present invention will be described in more detail by way of examples with reference to the accompanying drawings.

Outline of Coating Method

Figure 1:
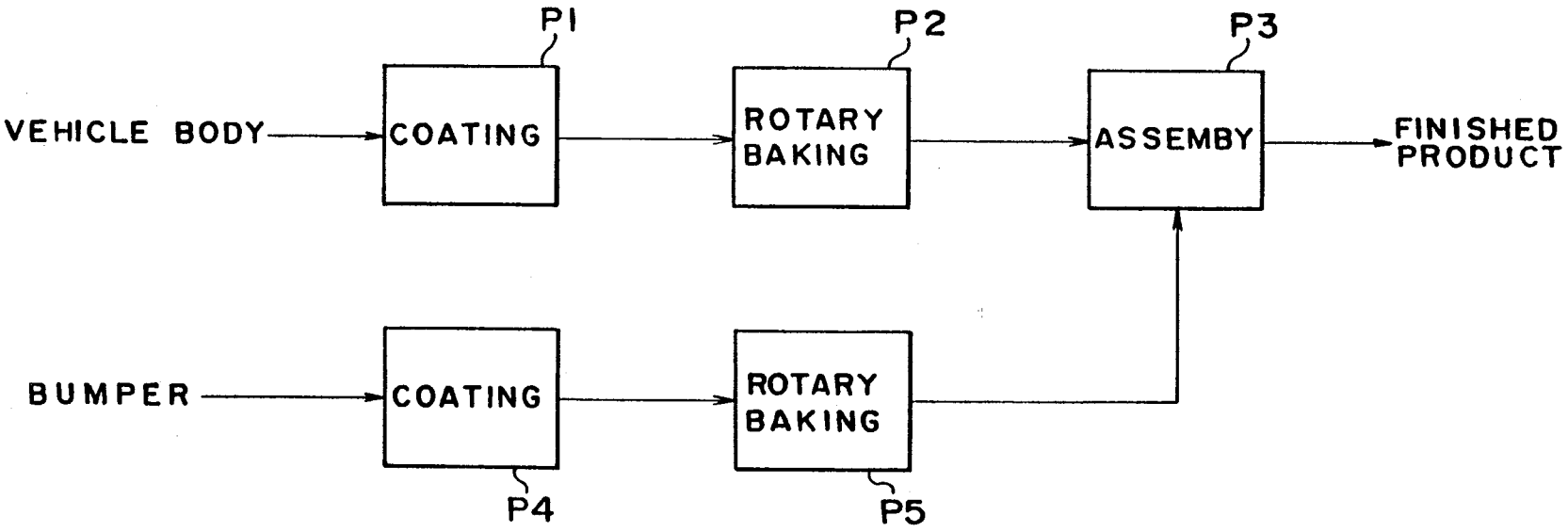
FIG. 1 is a schematic diagram showing an outline of the coating method according to the present invention.

FIG. 1 shows an outline of the whole steps of the coating method according to the present invention, in which a vehicle body W and a bumper, taken as an example of a plastic part, as a coating substrate, is coated by spraying the substrate with a paint. As shown in FIG. 1, the coating method for coating the vehicle body W is carried out in a coating line which comprises roughly a coating step P1, a rotary baking step P2, and an assembly step P3, while the coating method for coating the bumper comprises a coating step P4, a drying step P5, and the assembly step P3.

The vehicle body W is first undercoated by per se known coating methods such as electrodeposition. The vehicle body W undercoated is conveyed while being supported by a carriage to the coating step P1 where the body W is sprayed with a paint in a desired color to form a coat. The body W is then transferred to the drying step step P2. In the drying step P2, the coat on the body is set and baked to thereby dry the coat to a sufficient degree of dryness. After drying, the body W is transferred to the assembly step P3 where it is assembled with parts including the bumper which is transferred to this step from another coating line.

On the other hand, the bumper and other parts may be coated in another coating line which comprises the coating step P4 and the drying step P5 and then assembled with the body W at the assembly step P3.

In the coating steps P1 and P4, the substrates are to be coated with a paint to form a coat in a film thickness thicker than a thickness that causes sagging if the coat would be stayed as it is. In the drying steps P2 and P5, the substrates are rotated about their substantially horizontal axes, respectively, in such a manner as shown in FIG. 2, until the coats are set and dried to a sufficient degree of dryness.

Figure 2:
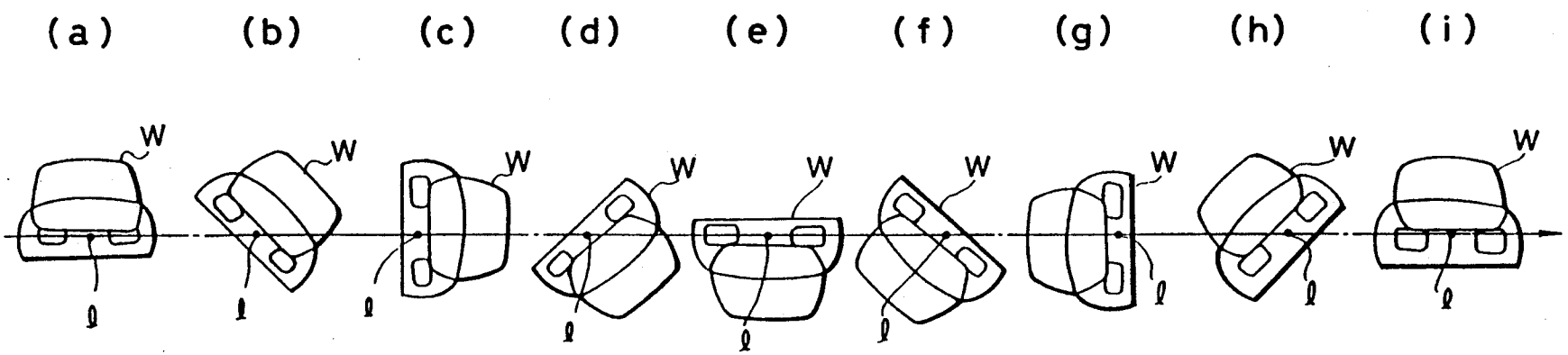
FIG. 2 is a schematic diagram showing a variation of positions of a vehicle body at which it is rotated.

Referring to FIG. 2, a manner of rotating the substrate will be described more in detail. FIG. 2(*a*) shows an original position at which the body W is mounted on the carriage. FIG. 2(*b*) shows a position of the body W in which it is rotated at 45 degrees from the original position of FIG. 2(*a*). FIGS. 2(*c*), (*d*), and (*e*) show positions at which it is rotated at 90 degrees, 135 degrees, and 180 degrees, respectively, from the original position thereof. As shown in FIGS. 2(*f*), (*g*) and (*h*), the body W is further rotated at 225 degrees, 270 degrees, and 315 degrees, respectively, from the original position shown in FIG. 2(*a*). FIG. 2(*i*) shows the position at which the body is rotated at 360 degrees from and returned to the original position of FIG. 2(*a*). It should be understood that FIG. 2 is shown merely as references and that the body W may take any position.

The vehicle body W may be rotated in one direction or rotated in one direction after another, in a continuous manner or in such an intermittent manner that it is rotated to a predetermined position and then suspended at that position. This operation may be repeated.

The combination of rotating the vehicle body W in one direction with the subsequent reversal of the rotation in the opposite direction is preferably conducted so as to prevent the sprayed paint from forming irregular film thicknesses and collecting locally at the corner portions formed by the intersecting surfaces extending in the rotational axis. This operation permits a uniform coat on the surface of the vehicle body W.

In order to control paint sagging, the vehicle body W may be preferably rotated so as to return a coated surface from a vertical state to a horizontal state until the paint coated thereon flows to a length of 1 to 2 mm.

As the vehicle body W is rotated, a centrifugal force works on the sprayed coat, thus causing the coat to sag. Such paint sagging is caused when a test piece of the coating substrate is coated at the angle of 180° and then reversed 180° for 0.25 seconds at a diameter of 30 cm, so that the speed of rotation of the coating substrate is less than the speed which caused the paint sagging on the test piece. Accordingly, a speed for rotating the vehicle body W may be 380 cm per second or less at the top end portion thereof, thus preventing paint sags from occurring by way of centrifugal forces, and the speed may not necessarily be constant. As the rotating radius of the coating substrate gets larger, the speed of rotation rotating radium of the coating substrate gets larger and the speed of rotation gets slower.

If the body W is rotated in one direction, the rotation may be continuously or intermittently carried out in a clockwise direction in FIG. 2, for example, in a cycle from the original position of FIG. 2(*a*) through FIGS. 2(*b*), (*c*), (*d*), (*e*), (*f*), (*g*), and (*h*) to the original position of FIG. 2(*i*). If it is rotated continuously or intermittently in alternate directions, the rotation may be carried out first in the clockwise direction in FIG. 2, for example, in a first quarter of one cycle from the original position of FIG. 2(*a*) through FIG. 2(*b*) to the position of FIG. 2(*c*) and then reversed back in a counterclockwise direction in a second quarter thereof from FIG. 2(*c*) through FIG. 2(*b*) to the original position of FIG. 2(*a*) and then in a third and quarter thereof from the original position of FIG. 2(*i*), i.e., FIG. 2(*a*), through FIG. 2(*h*) to the position of FIG. 2(*g*). In this case, the rotation of the body W is reversed again in a counterclockwise direction in a fourth quarter of one cycle from the position of FIG. 2(*g*) through FIG. 2(*h*) to the original position of FIG. 2(*i*), namely, FIG. 2(*a*). Furthermore, for example, if the rotation of the body W is reversed at the angle of 135 degrees, the body W is rotated first in a clockwise direction from the original position of FIG. 2(*a*) through FIGS. 2(*b*) and 2(*c*) to FIG. 2(*d*), and the rotation is reversed back in a counterclockwise direction therefrom through FIGS. 2(*c*) and (*b*) to FIG. 2(*a*). The body W is continued to be rotated therefrom, namely, from FIG. 2(*i*) through FIGS. 2(*h*), (*g*) to FIG. 2(*f*) and then reversed again in a clockwise direction therefrom through FIGS. 2(*g*)

and (*h*) to FIG. 2(*i*), namely, to the original position of FIG. 2(*a*). It is to be noted that the rotation of the body W may be reversed at any angle and it is not restricted at any means to those as have been described hereinabove. The angle at which the rotation of the vehicle body W is reversed may be determined on the basis of a direction in which gravity acts on the coating particularly on the up-and-downward direction and of a shape of the vehicle body W, particularly a location of its corner portions, and the like. Furthermore, it is to be noted that the rotation may be carried out intermittently in such a manner that the rotation is continued by repeating a run-and-stop operation.

A speed of the rotation of the vehicle body W may be determined depending upon a viscosity of the paint and a film thickness thereof coated on the surface of the substrate, such as the body W and the bumper. The rotational speed may vary within the range between the maximum value and the minimum value, a maximum value being defined as the maximum rotational speed at which the paint coated thereon causes no sagging as a result of centrifugal force and a minimum value being defined as the minimum rotational speed at which the surface is rotated from its vertical state to its horizontal state before the paint on the coating surface substantially sags due to gravity. The body W is preferably rotated at a speed of 380 cm per second or lower as measured at a radially outward tip portion of the body. An angle at which the body W is rotated about its substantially horizontal axis may be inclined at approximately 30 degrees, preferably at approximately 10 degrees, with respect to its horizontal axis.

A period of time when the rotation of the vehicle body W is carried out is sufficient if it lasts at least from the instance when the coating starts sagging to the instance when the coating is cured to such an extent to cause no sagging during the drying step. It is also possible to carry out the rotation all over the drying steps P2 and P5.

Specific Examples of Coating on Body

The following are details of the paints used for the above experiments and the conditions for spraying the paints in the above experiments.

A. Undercoating

The undercoating is implemented by the following coating conditions when any undercoating paint is used.

Method of coating: Electrodeposition
Baking: 170° C. for 30 minutes
Film thickness: 20±2 μm B. Coating over Undercoat:

(1) Thermosetting Paints:

(a) Intercoating:

Paint: Thermosetting-type, oil-free, polyester paint; gray
Viscosity for spraying: 22 seconds; Ford Cup #4, 20° C.

Coater:
Minibell (bell size: 60 mm)
Number of revolutions: 22,000 rpm
Voltage: −90 kv
Shaping air pressure: 3.0 kg/cm$^2$
Distance from gun: 30 cm Setting: 10 minutes at room temperature
Baking: 140° C. for 25 minutes (2) Overcoating:

Paint:
Melamine alkyd high-solid thermosetting-type paint (main resinous component: average molecular weight, 2,800; color: black)
Viscosity for spraying: 20 seconds; Ford Cup #4, 20° C.
Non-volatilizable components: 48% by weight
Solvents: Toluene, 25 parts by weight; Solvesso 100, 25 parts by weight; Solvesso 150, 50 parts by weight
Agent for preventing sags: cross-linked acrylic resin powder, 3% by weight based on the weight of the non-volatilizable components Coater:
Minibell (bell size: 60 mm; Nippon Lundsberg, K.K.)
Number of revolutions: 1,600 rpm
Voltage: −90 kv
Shaping air pressure: 3.0 kg/cm$^2$
Distance from gun: 30 cm Spraying: two-stages in the interval of 5 minutes
Atmosphere: 20° C.±2° C.
Air velocity in booth: 0.3±0.1 m/second (push-and-pull down flow)

Setting: 20° C.±2° C. for 10 minutes
Baking: 140° C. for 25 minutes
Rate of elevating: 8 minutes (from 20° C. to 140° C.)

Rotating: Rotating the body W about its horizontal axis away by 75 cm from the central axis thereof so as to allow its both side surfaces parallel to each other at the speed of 6 rpm.

(2) Two-Liquid Type Paint:

(a) Intercoating:

Paint: Polyester urethane paint; gray ("P-026"; Nippon Bee Chemical K.K.)
Main resin: polyester polyol
Curing agent: hexamethylene diol
Admixture ratio: 4 (main resin) to 1 (curing agent)

Coater: Pressure-flow type air spray gun (Iwata Tosoki K.K.; "Wider-W71")

Spraying viscosity: 16 seconds/Ford Cup #4, 20° C.
Shaping air pressure: 4.0 kg/cm$^2$
Distance from gun: 30 cm
Setting: 10 minutes at room temperature
Baking: 90° C. for 25 minutes (b) Overcoating:

Paint: Polyester urethane paint; white ("P-263"; Nippon Bee Chemical K.K.)
Main resin: Polyester polyol, white
Curing agent: hexamethylene diisocyanate
Admixture Ratio: 4 (main resin) to 1 (curing agent)

Coater: Pressure-flow type air spray gun (Iwata Tosoki K.K.; "Wider-W71")

Viscosity for spraying: 16 seconds; Ford Cup #4, 20° C.
Shaping air pressure: 4.0 kg/cm$^2$
Distance from gun: 30 cm
Spraying: two-stages in the interval of 5 minutes
Setting: room temperature for 10 minutes
Baking: 90° C. for 25 minutes
Rate of elevating: 5 minutes (from 20° C. to 90° C.)
Rotating: the same as the thermosetting paint (3) Powder Paint:

(a) Intercoating:

Paint: Epoxy powder paint; gray ("Powdax E"; Nippon Paint K.K.)

Coater: Electrostatic powder coater ("GX 101"; Onoda Cement K.K.)
Pressure: −60 kv
Amount of atomizing paint: 180 grams per minute
Paint conveying air pressure: 2.0 kg/cm$^2$ Distance from gun: 25 cm
Drying: 170° C. for 25 minutes Elevated for 8 minutes from 20° C. to 170° C.
(b) Overcoating:
Paint: Acrylic powder paint ("Powdax A"; Nippon Paint K.K.)
Coater: Electrostatic powder coater ("GX101"; Onoda Cement K.K.)
Pressure: −60 kv
Amount of atomizing paint: 180 grams per minute
Spraying at two stages in the interval of 5 minutes
Paint conveying air pressure: 2.0 kg/cm$^2$
Distance from gun: 25 cm
Drying: 170° C. for 25 minutes
Elevated for 8 minutes from 20° C. to 170° C. Rate of elevating: 5 minutes (from 20° C. to 170° C.)
Rotating: the same as the thermosetting paint

Paints for Vehicle Body

The paints to be used for coating particularly vehicle bodies may be any paint containing a resin having a number average molecular weight ranging from 2,000 to 20,000, as shown in Table 1 below. They may include, for example, thermosetting paints, two-component type paints, powder paints and so on. The paints may be conveniently chosen depending upon the kind of coating processes to be applied as well as the speed of rotation. As needed, the paints may be used, for example, by adding a sagging preventive agent thereto or by diluting them with a solvent on site.

The paints also may include a solid coat of conventional type and of high solid type, a metallic base coat of conventional type and of high solid type, and a metallic clear coat of conventional type and of high solid type. The solid coat of an alkyd melamine resin of conventional type may have a number mean molecular weight ranging from about 4,000 to about 5,000 and of high solid type from about 2,000 to 3,000; the metallic base coat of an acrylic melamine resin of conventional type may have a number mean molecular weight from about 15,000 to about 20,000 and of high solid type from about 2,000 to about 3,000; the metallic clear coat of an acrylic melamine resin of conventional type may have a number mean molecular weight from about 5,000 to about 6,000 and of high solid type from about 2,000 to about 3,000; and the solid coat of a urethane isocyanate resin of conventional type may have a number mean molecular weight from about 7,000 to about 10,000 and of high solid type from about 2,000 to about 3,000. The paints having a number mean molecular weight below about 2,000, on the one hand, are in many cases of the type in which they are cured by electron beams or by ultraviolet rays and they are hard and frail, when cured, leading to the shortening of durability, because their density of cross-linkage is too high. Thus such paints are inappropriate for coating exterior panels of the vehicle body. The paints having a number mean molecular weight above 20,000, on the other, are of the type in which they have a very high viscosity so that they require a large amount of a solvent to dilute. Thus high costs are required to treat the solvent discharged. A latex polymer with a number mean molecular weight over 200,000 is not appropriate because its viscosity is elevated immediately after spraying, thus adversely affecting a degree of flatness on a coating surface.

TABLE 5

| Paint | Resin | Type | Number-Average Molecular Weight |
|---|---|---|---|
| Solid Paint | Melamine | General | 4,000–5,000 |
| | Alkyd | High Solid | 2,000–3,000 |
| Metallic Base Paint | Melamine | General | 15,000–20,000 |
| | Acrylate | High Solid | 2,000–3,000 |
| Metallic Clear Paint | Melamine | General | 5,000–6,000 |
| | Acrylate | High Solid | 2,000–3,000 |
| Solid Paint | Urethane | General | 7,000–10,000 |
| | Isocyanate | High Solid | 2,000–3,000 |

Relationship of Film Thickness of Paint with Speed of Paint Sagging

Figure 3:
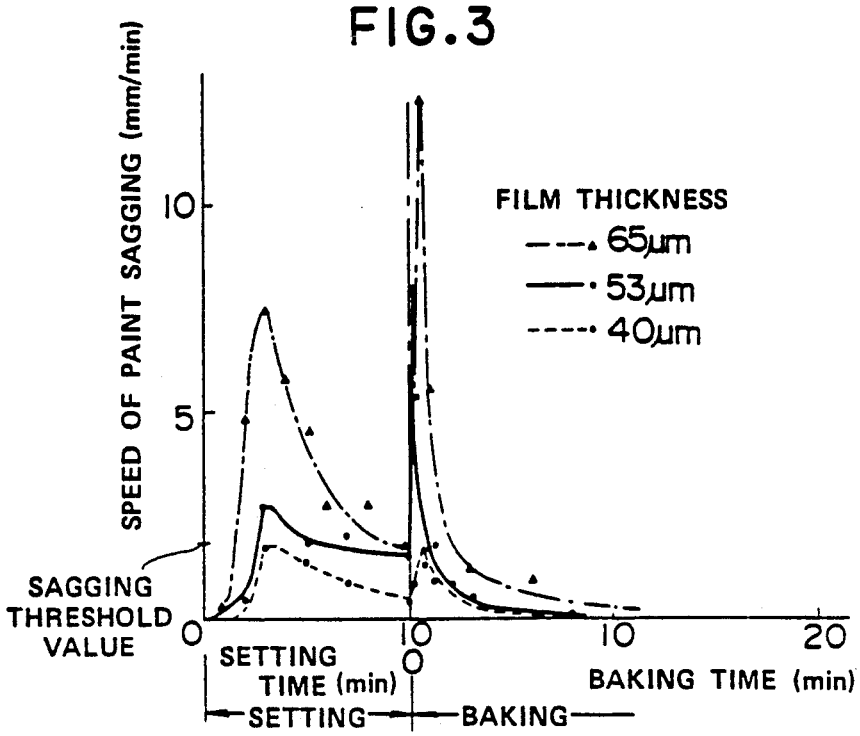
FIG. 3 is a graph showing the relationship of the setting and baking times vs. velocities at which the paint sags.

FIG. 3 shows influences of film thicknesses of a thermosetting paint upon the speed at which the paint sags. FIG. 3 takes film thickness of 40 μm, 53 μm, and 65 μm as examples. In each case, the speed of the sagging is greatest in the early stages of both the setting step and the baking step. The sagging threshold value or sagging limit thickness is usually defined as the value at the time when sags are caused to occur at a rate ranging from 1 to 2 mm per minute. It is understood that, if sags would occur at a rate of 2 mm or more per minute when visually observed, coat surfaces will not be adequate. With conventional methods using a conventional paint, the maximum film thickness that had ever been obtained at a range below a sagging threshold value was as thin as about 40 μm.

Relationship of Film Thickness with Degree of Flatness

Figure 4:
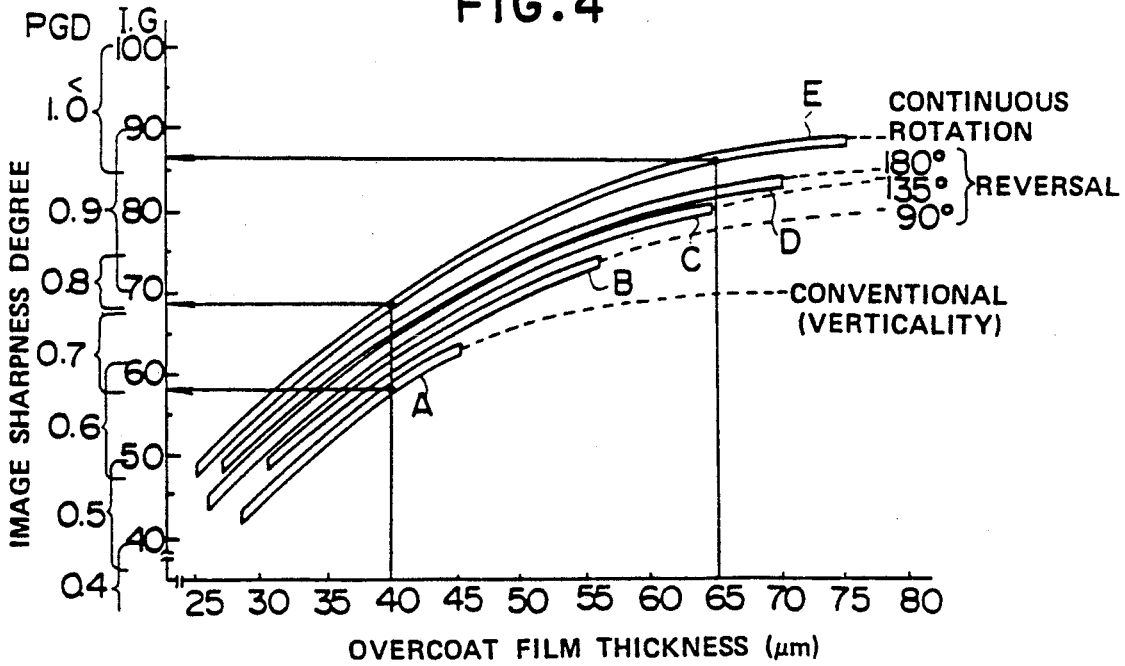
FIG. 4 is a graph showing the relationship of film thicknesses of the overcoat vs. degrees of image gross with respect of rotation of the substrate.

FIG. 4 shows the effects of the horizontal rotation of the vehicle body W on evenness of coats. In FIG. 4, reference symbol A denotes a state of a coat coated by a conventional coating method where the vehicle body is not rotated. Reference symbol B denotes the state of a coat obtained by rotating the vehicle body W which in a clockwise direction at the angle of 90 degree and then reversing direction and rotating the vehicle body W back at the angle of 90 degrees, namely, rotating it from the position of FIG. 2(*a*) through (*b*) to (*c*) and then returning it from the position of FIG. 2(*c*) through (*b*) back to the original position (*a*). Reference symbol C denotes the state of the coat obtained by rotating the vehicle body W at the angle of 135 degrees, then reversing direction, ending at the original position, namely, rotating it from the position of FIG. 2(*a*) through (*b*) and (*c*) to (*d*) and then returning it from the position of FIG. 2(*d*) through (*c*) and (*b*) back to the original position of FIG. 2(*a*). Reference symbol D denotes the state of a coat obtained by rotating the vehicle body W at the angle of 180 degrees in a clockwise direction from the position of FIG. 2(*a*) through (*b*), (*c*) and (*d*) to (*e*) and the back to the original position of FIG. 2(*a*) through (*d*), (*c*) and (*b*) from (*e*). In FIG. 4, reference symbol E denotes the state of a coat obtained when the vehicle body W is rotated a full revolution in on direction from the original position of FIG. 2(*a*) through (*b*), (*c*), (*d*), (*e*), (*f*), (*g*) and (*h*) back again to the original position of FIG. 2(*i*).

As is apparent from the results of FIG. 4, if the film thicknesses of two coats are identical to each other, a higher degree of evenness in the coat is achieved when the vehicle body W is rotated, as shown by reference symbols B, C, D and E in FIG. 4, than when it is not rotated, as shown by reference symbol A in FIG. 4. It is also noted that, in instances where the vehicle body W is rotated, the round rotation of the vehicle body W in one direction by 360 degrees is preferred to provide a coat with a higher degree of evenness. It should further be noted that, in instances where the vehicle body W is not rotated as in the conventional manner, the film thickness of the coat is restricted to a certain value, thus leading to limited degree of evenness.

To determine the degree of smoothness or flatness on a coated surface, an image sharpness degree is used which assigns a mirror surface on a black glass an I.G. (image gross) score of 100. By comparison, a film thickness of 65 μm formed by rotating the vehicle body W at the angle of 360 degrees, gets an 87 on the I.G. scale (the lower limit at a PGD value being 1.0), which means that the coated surface has 85% of the I.G. score for the mirror surface of the black glass. A film thickness of 40 μm scores a 58 (the lower limit at a PGD value being 0.7) when formed without rotation of the vehicle body W and a 68 (the lower limit at a PGD value being 0.8) when formed by rotating it at 360 degrees. In the above definition, PGD values stand for a degree of identification of a reflected image and is rated so as to be decreased from 1.0 as the degree of smoothness gets lower.

The data shown in FIGS. 3 and 4 were obtained by overcoating in the spraying step P2 above under following test conditions:

a) Paint: melamine alkyd (black)
   Viscosity: 22 seconds/20° C. (measured by Ford Cup #4)
b) Film coater: Minibell (16,000 r.p.m.)
   Shaping air: 2.0 kg./cm$^2$)
c) Spraying amounts: sprayed two times
   First time: 100 cc/minute
   Second time: 150–200 cc/minute
d) Setting time/temperature: 10 minutes/room temperature
e) Baking temperature/time: 140° C./25 minutes
f) Degree of flatness on overcoat surface: 0.6 (PGD) (intercoating on PE tape)
g) Time period for rotation and reversal: 10 minutes (for the setting step) 10 minutes (for the baking step)
h) Material to be coated: The side surfaces of a square pipe with a 30 cm side are coated and supported at its center so the pipe may rotate.
i) Rotational speed of the material to be coated: 6, 30, and 60 r.p.m.

It is found that there is no difference in degrees of flatness on the coat surfaces has in fact been recognized by the different rotational speeds of the material to be coated.

Coating Bumpers And Other Parts

Parts including bumpers, fascia boards, door handles and so on to be mounted on the vehicle body W in the assembly step P3 in FIG. 1 are coated in the coating step P4 in FIG. 1 separately from the coating on the vehicle bodies. The parts are coated, then set and baked in the steps P4 and P5 in FIG. 1 in substantially the same manner as the vehicle bodies are coated, set and baked in the steps P1 and P2 in FIG. 1.

Figure 16:
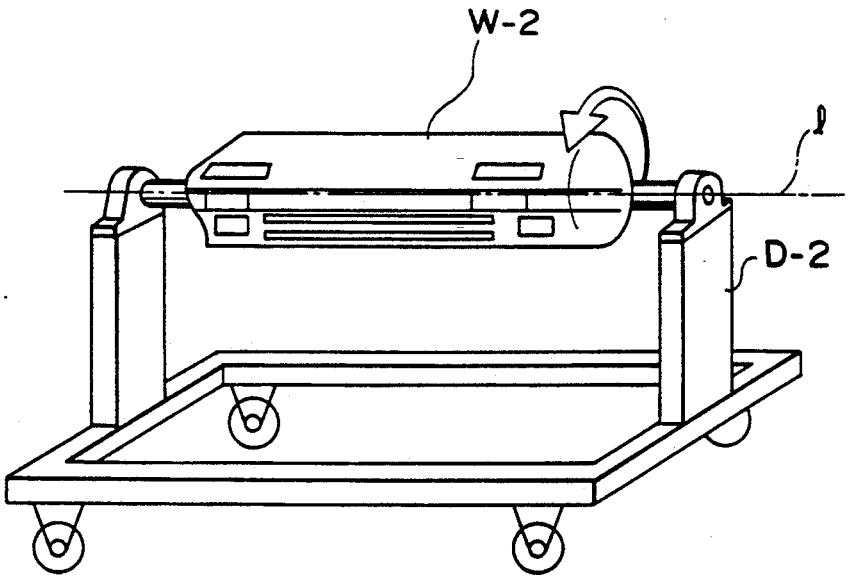
FIG. 16 is a perspective view showing a carriage for rotating a bumper.

The door handles and other parts which are made of a steel plate, on the one hand, may be coated with the same paint under the same coating and baking conditions as the vehicle bodies. The bumpers, fascia boards and other plastic parts may be coated, set and baked under the following conditions:

Paint: Urethane (black or clear)
Spraying viscosity: 15 seconds/20° C. (Ford Cup #4)
Coater: Minibell The coating conditions are the same as the vehicle bodies W.
Rate of spraying: The same as the vehicle bodies W.
Rotational speed of the substrate: The same as the vehicle bodies W.
Film thickness: 65±5 μm
Setting: The same as the vehicle bodies W.
Baking: 90° C./25 minutes As shown in FIG. 16, the bumpers W-2 and other plastic parts may be coated on a carriage D-2. These substrates loaded on the carriage D-2 may be rotated about a substantially horizontal axis l thereof. A flexible paint as the urethane paint used may present the advantage that a coat can be prevented from coming off upon a contact or crash with other things.

The coat on the bumpers W-2 was found to provide a PGD value of 1.5 as high as the coat on the vehicle body.

Figure 17:
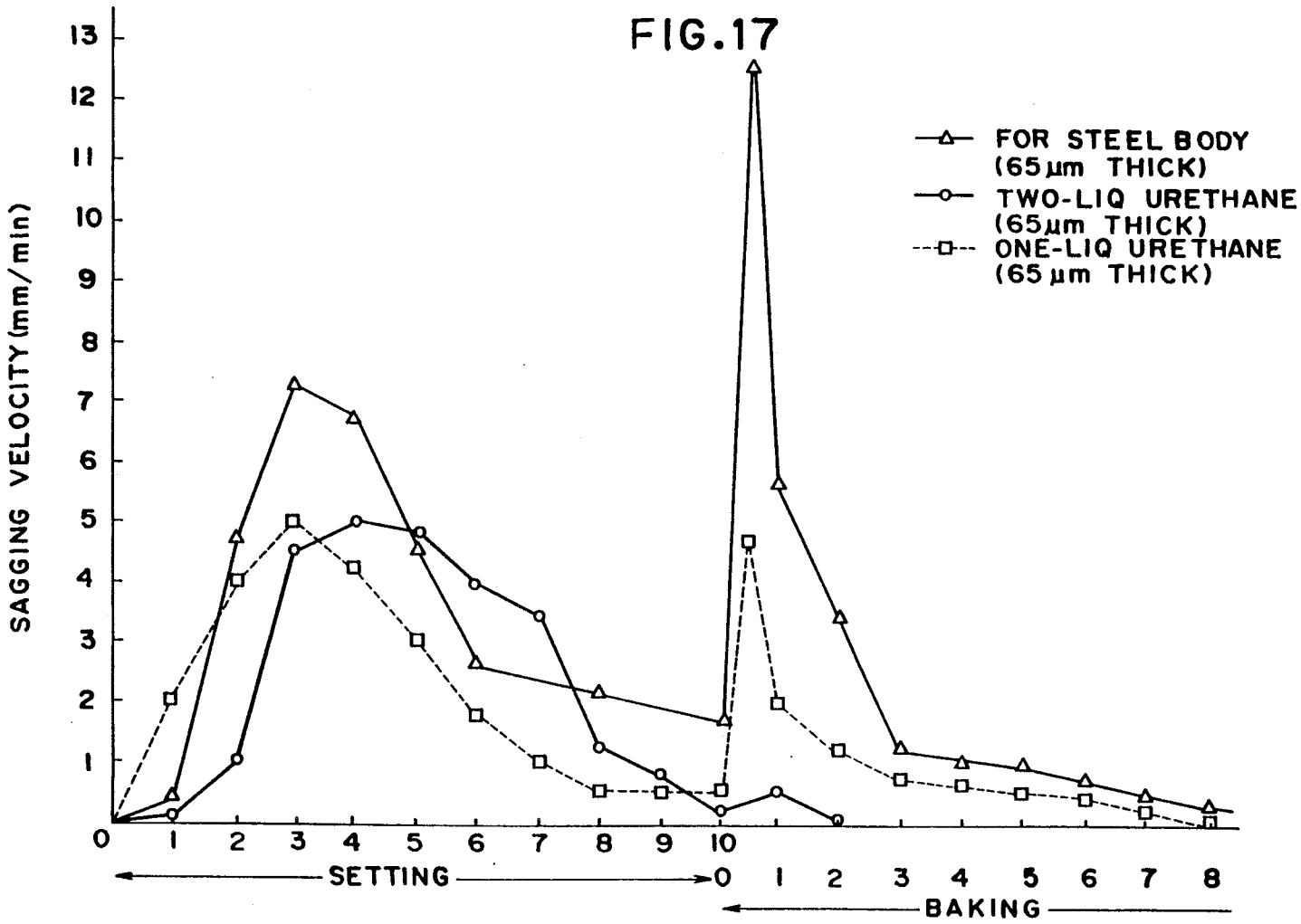
FIG. 17 is a graph showing characteristics of paints to be coated on the vehicle body and plastic parts.

Generally speaking, as paints to be used for coating plastic parts including bumpers, there may be frequently used a one-liquid urethane paint and a two-liquid urethane paint under coating conditions as will be illustrated in Tables 2A and 2B below. Tables 2A and 2B take a thermosetting paint and urethane paints as examples, Table 2A showing an example of an application of the thermosetting paint to a vehicle body made of a steel plate and Table 2B showing examples of application of the urethane paints to a R-RIM fascia board. FIG. 17 shows characteristics of sags of a paint to be coated under the conditions as illustrated in Tables 2A and 2B below.

TABLE 2A

| Test Conditions | | Vehicle Body Thermosetting Melamine Alkyd Resin (Black) |
|---|---|---|
| Spraying Viscosity (Ford Cup #4, 20° C.) | | 22 seconds |
| Non-volatiles (%) (during spraying) | | 48 |
| Coating Conditions (Minibell) | | |
| number of revoltn | | 16,000 r.p.m. |
| shaping air press. | | 2.0 kg/cm$^2$ |
| voltage | | 90 KV |
| distance from gun | | 30 cm |
| Amount of Spraying | 1st stage | 75 cc/min 100 cc/min |
| | interval | 5 minutes |
| | 2nd stage | 120 cc/min 180 cc/min |
| Dry film thickness | | 35 μm 65 μm |
| Setting Conditn | temp. | 22° C. |
| | time | 10 min. |
| | rotation | none 6 rpm aft. 1 minute |
| Baking | temp | 140° C. |
| | time | 25 minutes |
| | rate | 22° C.→140° C./8 minutes |
| Rotational conditn | | none 6 rpm (160 min) |
| Conveyor velocity | | 3.0 m/minute |
| Gloss (PGD value) | | 0.6 1.0 |

TABLE 2B

| Test Conditions | Vehicle Body Thermosetting Melamine Alkyd Resin | R-RIM Fascia Board: One-Liquid Urethane (Black) Main: Acrylic resin Curing agent: Polyisocyanate | R-RIM Fascia Board: Two-Liquid Urethane (Black) Main: Melamine-curable urethane Curable agent: Modified alkyd resin |
|---|---|---|---|
| Spraying Viscosity (Ford Cup #4, 20° C.) | 22 seconds | 15 seconds | 20 seconds |
| Non-volatiles (%) (during spraying) | 48 | 40 | 36 |
| Coating Conditions (Minibell) | | | |
| number of revoltn | 16,000 r.p.m. | 16,000 r.p.m. | 16,000 r.p.m. |
| shaping air press. | 2.0 kg/cm$^2$ | 2.0 kg/cm$^2$ | 2.0 kg/cm$^2$ |
| voltage | 90 KV | 90 KV | 90 KV |
| distance from gun | 30 cm | 30 cm | 30 cm |
| Amount of Spraying 1st stage | 75 cc/min 100 cc/min | 100 cc/min 160 cc/min | 120 cc/min 180 cc/min |
| interval | 5 minutes | 5 minutes | |
| 2nd stage | 120 cc/min 180 cc/min | | |
| Dry film thickness | 35 μm 65 μm | 35 μm 65 μm | 35 μm 65 μm |
| Setting Conditn temp. | 22° C. | 22° C. | 22° C. |
| time | 10 min. | 10 min. | 10 min. |
| rotation | none 6 rpm aft. 1 minute | none 3 rpm aft. 2 minute | none 3 rpm just aft. coatg |
| Baking temp | 140° C. | 90° C. | 120° C. |
| time | 25 minutes | 30 minutes | 25 minutes |
| rate | 22° C.→140° C./8 minutes | 22° C.→90° C./5 minutes | 22° C.→120° C./7 minutes |
| Rotational conditn | none 6 rpm (160 min) | none none | none 3 rpm (8 min) |
| Conveyor velocity | 3.0 m/minute | 1.5 m/minute | 1.5 m/minute |
| Gloss (PGD value) | 0.6 1.0 | 0.6 1.2 | 0.4 0.8 |

In Table 2B above, the two-liquid urethane resin contains the main agent at the rate of 70% by weight and the curable agent at the rate of 10% by weight.

The one-liquid urethane resin may be flexible at ambient temperature, and the melamine portion gets cured at elevated temperature of 120° C. while a flexibility resulting from the urethane resin portion gets weaker. If the temperature becomes higher than 120° C., the plastic substrate transforms. In the above example, the fascia boards made of a plastic material are so small in an area to be coated and a conveyor velocity for conveying the fascia boards is slower by a half than that for conveying the vehicle bodies W, so that the paint is sprayed by a "one-stage" spraying. It is to be noted that finished coats have a gloss (PGD values) different from each other, even if their film thicknesses are the same, because the paints used have different characteristics.

A combination of the paints to be used for coating the vehicle bodies with the paints to be used for coating the plastic parts may be arbitrarily chosen. It is preferred that the plastic parts are pre-treated prior to coating, by degreasing and surface-treating using electrically conductive plasma in order to improve adhesion of the paint to the substrate. It is further to be noted that the plastic parts contain a conductive agent such as carbon to deal with electrostatic coating.

Rotation Jig and Carriage

Description on a rotation jig and a carriage for use for the rotation of the coating substrate such as the vehicle body W will be made hereinafter in conjunction with FIGS. 5 to 15.

Rotation Jig

The vehicle body W is mounted horizontally on the carriage through a pair of rotation jigs so as to be rotatable about its axis extending horizontally in a longitudinal direction of the body W.

Figure 5:
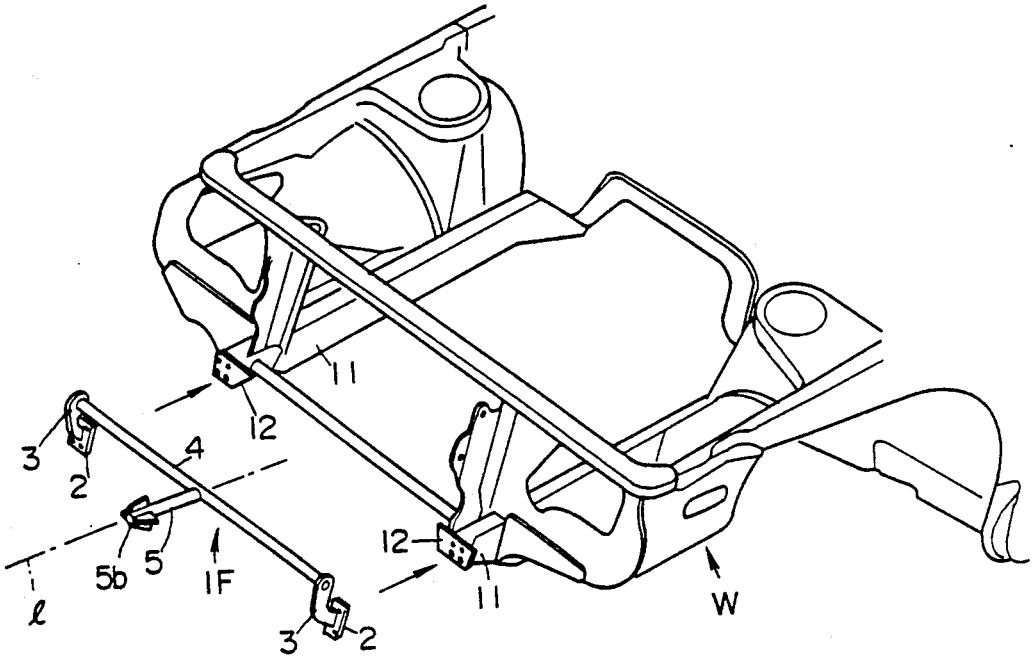
FIG. 5 is a perspective view showing a front jig for rotating the vehicle body.

FIG. 5 shows a front rotation jig 1F for horizontally supporting a forward portion of the body W. The front rotation jig 1F comprises a pair of left-hand and right-hand mounting brackets 2, a pair of left-hand and right-hand stays 3 welded to the corresponding left-hand and right-hand mounting brackets 2 and a connection bar 4 for connecting the pair of the stays 3, and a rotary shaft 5 connected integrally to the connection bar 4. The front rotation jig 1F is fixed at its portions of the brackets 2 to a forward end portion of a front reinforcing member of the vehicle body W such as a front side frame 11. To the front side frame 11 is usually welded mounting brackets 12 for mounting a bumper (not shown), and the brackets 2 are fixed with bolts (not shown) to the brackets 12 on the side of the body W.

Figure 6:
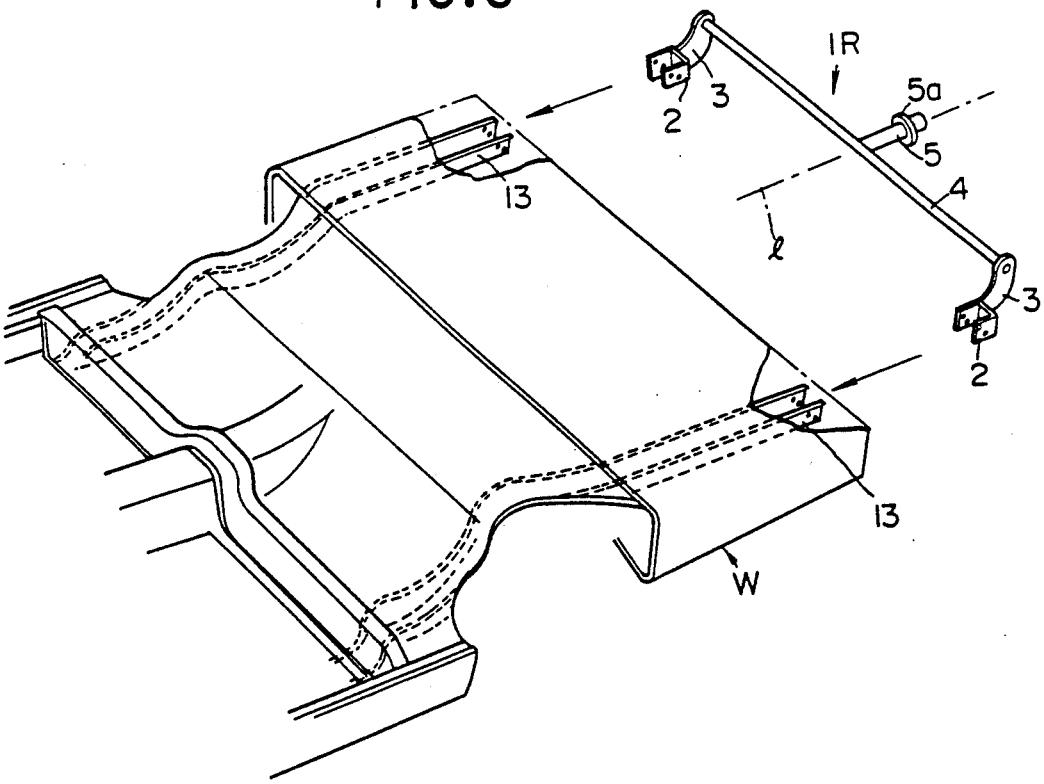
FIG. 6 is a perspective view showing a rear jig for rotating the vehicle body.

FIG. 6 shows a rear rotation jig 1R for horizontally supporting a rearward portion of the vehicle body W, which substantially the same structure as the front rotation jig 1F. In the drawing, the same elements for the rear rotation jig 1R as for the front rotation jig 1F are provided with the same reference numerals as the latter. The mounting of the rear rotation jig 1R to the vehicle body W is effected by fixing brackets 2 with bolts (not shown) to the floor frame 13 disposed at a rearward end portion of the vehicle body W as a rigidity adding member. Alternatively, the rear rotation jig 1R may be mounted to the body W through a bracket for mounting the bumper, the bracket being welded to a rearward end portion of the floor frame 13.

Figure 7:
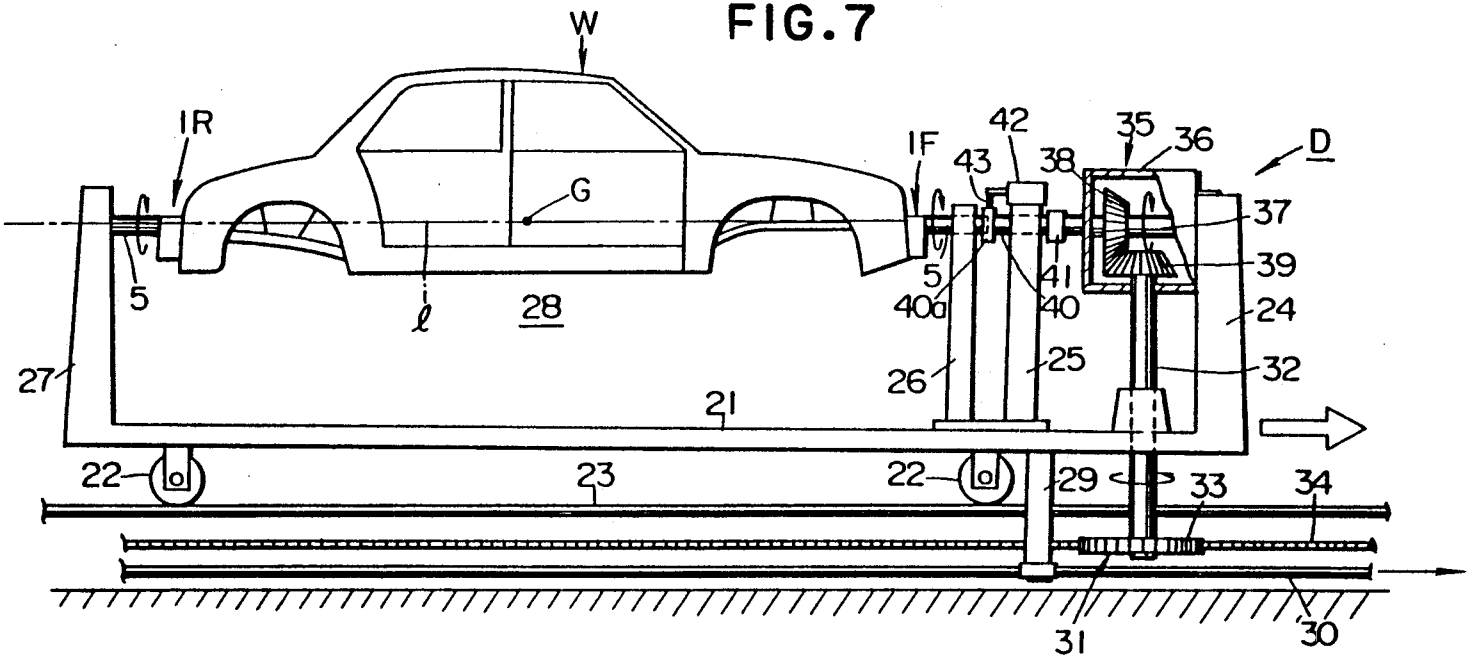
FIG. 7 is a side view showing the side portion of a vehicle-body conveying carriage for rotating the vehicle body.
Figure 9:
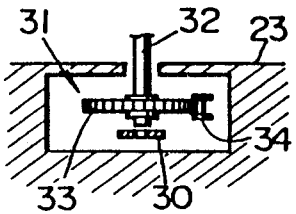
FIG. 9 is a cross-sectional view taken along line X9—X9 of FIG. 8.
Figure 8:
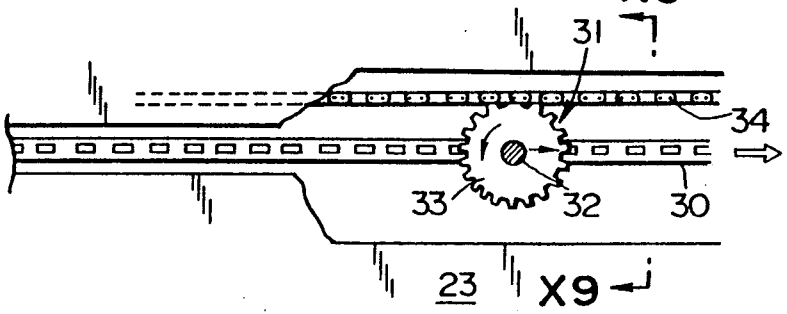
FIG. 8 is a partially cut-out plane view showing the structure of a conveying means underneath a passageway on which the carriage travels.

The front and rear rotation jigs 1F and 1R are mounted to the body W in such a manner that their respective rotary shafts 5 extend horizontally on the same straight line in its longitudinal direction when the body W is mounted on the carriage D through the front and rear rotation jigs 1F and 1R. The very straight line is the horizontal axis l about which the body W is rotated. It is preferred that the horizontal axis is designed so as to pass through the center of gravity G of the body W as shown in FIG. 7. The arrangement for the horizontal axis l to pass through the center of gravity G serves as preventing a large deviation of a speed of rotation. This can prevent an impact upon the body W accompanied with the large deviation in rotation, thus preventing the paint coated from sagging.

The front and rear rotation jigs 1F and 1R may be prepared for exclusive use with the kind of vehicle bodies.

Carriage

The carriage which will be described hereinbelow is a carriage that may be used at least during the coating step P2 and/or in the setting step P3 and that is provided with a mechanism for rotating or turning the vehicle body W about its horizontal axis l extending in a longitudinal direction thereof.

Referring to FIG. 7, the carriage D is shown to include a base 21 and wheels 22 mounted to the base 21 with the wheels 22 arranged to operatively run on rails 23. On the base 21 is mounted one front support 24, two intermediate supports 25 and 26, and one rear support 27, each standing upright from the base 21, as shown in the order from the forward side to the rearward side in a direction in which the vehicle body W is conveyed. Between the intermediate supports 25, 26 and the rear support 27 is formed a space 28 within which the body W is mounted through the front and rear rotation jigs 1F and 1R.

The vehicle body W is loaded in the space 28 and supported rotatably at its forward portion by the intermediate support 26 through the front rotation jig 1F and at its rearward portion by the rear support 27 through the rear rotation jig 1R.

Figure 10:
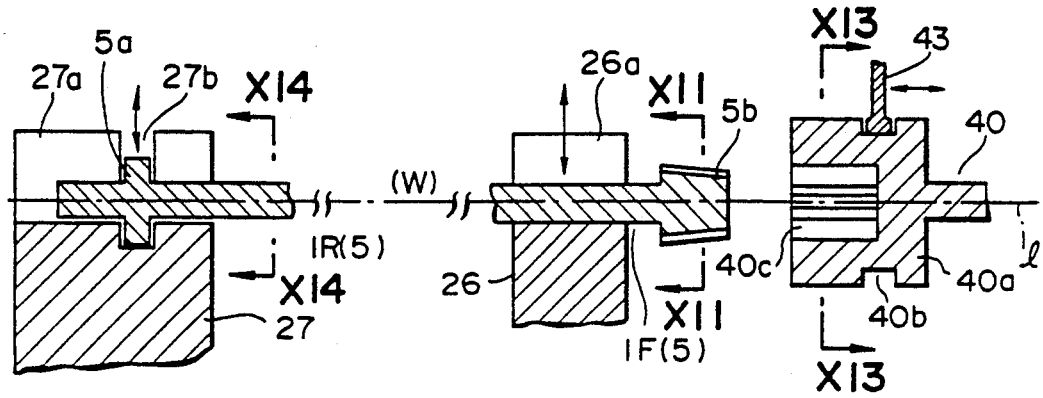
FIG. 10 is a cross-sectional side view showing a connecting portion at which the carriage is connected to a rotary jig.
Figure 11:
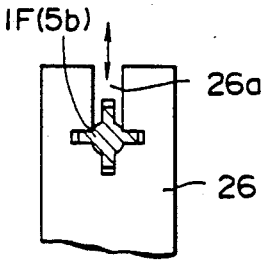
FIG. 11 is a cross-sectional view taken along line X11—X11 of FIG. 10.
Figure 13:
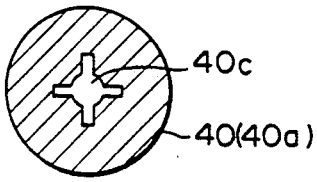
FIG. 13 is a cross-sectional view taken along line X13—X13 of FIG. 10.
Figure 12:
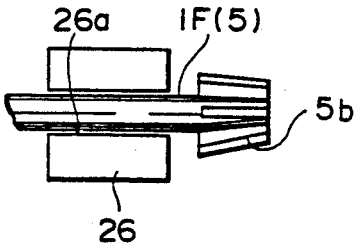
FIG. 12 is a plan view of FIG. 10.

As shown in FIGS. 10, 11, and 12, on the one hand, the intermediate support 26 is provided at its top surface with a groove **26*a* which in turn is designed so as to engage or disengage the rotary shaft 5 of the front rotation jig 1F with or from the support 26** in a downward direction or in an upward direction.

Figure 14:
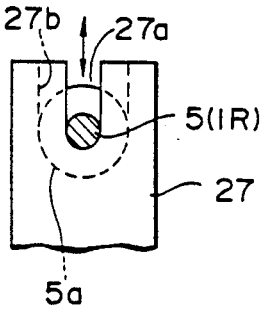
FIG. 14 is a cross-sectional view taken along line X14—X14 of FIG. 10.
Figure 15:
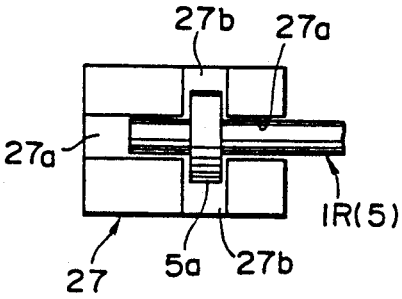
FIG. 15 is a plan view of FIG. 14.

As shown in FIGS. 10, 14, and 15, on the other hand, the rear support 27 is provided at its top surface with a groove **27*a* which engages or disengages the rotary shaft 5 of the rear rotation jig 1R with or from the rear support 27. The rear rotation jig 1R is further provided with a groove 27*b* in a shape corresponding to a flange portion 5*a* provided on the rotary shaft 5 of the rear rotation jig 1R, the groove being communicated with the groove 27*a***.

This arrangement permits the engagement or disengagement of the rotary shafts 5 with or from the front and rear rotation jigs 1F and 1R in a downward direction or in an upward direction, but it allows the rear rotation jig 1R to be unmovable in a longitudinal direction in which the horizontal axis extends due to a stopper action of the flange portion **5*a***.

As shown in FIGS. 10, 11, and 12, the rotary shaft 5 of the front rotation jig 1F is provided at its end portion with a connection portion **5*b* through which a force of rotation of the rotary shaft 5 of the front rotation jig 1F** is applied to the vehicle body W, as will be described hereinbelow.

From the base 21 extends downwardly a stay 29 to a lower end portion of which is connected a retraction wire 30. The retraction wire 30 is of endless type and is drivable in one direction by a motor (not shown). The retraction wire 30 thus drives the carriage D in a predetermined direction in which the body W should be conveyed. The motor should be disposed in a safe place from the viewpoint of security from explosion.

The rotation of the vehicle body W may be carried out using a movement of the carriage D, that is, using a displacement of the carriage D with respect to the rails 23. The displacement of the carriage D may be converted to a force of rotation using a mechanism 31 for converting the displacement of the carriage D into rotation. The mechanism 31 comprises a rotary shaft 32 supported rotatably by the base 21 and extending in a vertical direction from the base 21, a sprocket 33 fixed on the lower end portion of the rotary shaft 32, and a chain 34 engaged with the sprocket 33. The chain 34 is disposed in parallel to the retraction wire 30 in such a state that it does not move along the rails 23. As the carriage D is retracted by the retraction wire 30, the sprocket 33 allows the rotary shaft 32 to rotate because the chain 34 is unmovable.

A force of rotation of the rotary shaft 32 is transmitted to the rotary shaft 5 of the front rotation jig 1F through a transmitting mechanism 35 which comprises a casing 36 fixed on a rearward side surface of the front support 24, a rotary shaft 37 supported rotatably to the casing 36 and extending in a longitudinal direction of the body W, a pair of bevel gears 38 and 39 for rotating the rotary shaft 37 in association with the rotary shaft 32, and a connection shaft 40 connected to the front support 25 rotatably and slidably in the longitudinal direction thereof. The connection shaft 40 is spline connected to the rotary shaft 37, as indicated by reference numeral 41 in FIG. 7. This construction permits a rotation of the connection shaft 32 to rotate the rotary shaft 40. It is understood that the rotary shaft 37 and the connection shaft 40 are arranged so as to be located on the horizontal axis l extending in a longitudinal direction of the body W. The connection shaft 40 is connected to or disconnected from the front rotary shaft 5 of the front rotation jig 1F. More specifically, as shown in FIGS. 10 to 12, the front rotary shaft 5 of the front rotation jig 1F is provided at its end portion with a connecting portion **5*b* in a cross shape, while the connection shaft 40 is provided at its end portion with a box member 40*a* having an engaging hollow portion 40*c* that is engageable tightly with the connection portion 5*b* of the front rotary shaft 5 as shown in FIGS. 10 and 12. By slidably moving the connection shaft 40 by a rod 43, for example, using a hydraulic cylinder 42, the connection portion 5*b* is connected to or disconnected from the box member 40*a* at its engaging hollow portion 40*c*. The connection shaft 40 is rotatable integrally with the rotary shaft 5. The rod 43 is disposed in a ring groove 40*b* formed on an outer periphery of the box member 40*a*, as shown in FIG. 10, in order to cause no interference with the rotation of the connection shaft 40. With the above arrangement, the front and rear rotary shafts 5 of the respective front and rear rotation jigs 1F and 1R are supported by the intermediate support 26 and the rear support 27 so as to be rotatable about the horizontal and longitudinal axis yet unmovable in a longitudinal direction of the body W, when the body W is lowered with respect to the carriage D in a state that the connection shaft 40 is displaced toward the right in FIG. 7. Thereafter, the connection portion 5*b* of the rotary shaft 5 is engaged with the connection shaft 40 through the engaging hollow portion 40*c* thereof, whereby the body W is allowed to rotate about the predetermined horizontal axis l by retracting the carriage D by means of the retraction wire 30**. The vehicle body W can be unloaded from the carriage D in the order reverse to that described above.

As have been described hereinabove, when the paint is sprayed on surfaces extending upwardly and downwardly and on surfaces extending transversely or horizontally, as of vehicle bodies W, the problem may arise that a mass of the paint sprayed swells partially on the surfaces extending transversely or horizontally at a boundary area nearby the surface extending upwardly and downwardly due to a so-called "overspraying". It is to be noted, however, that the coating method according to the present invention can be applied to this problem and the coating method can overcome this by determining a film thickness or a depth of the difference in level of the concave portion on the substrate from the amount of the paint oversprayed.

It is to be understood that the foregoing text and drawings relate to embodiments of the present invention given by way of examples but not limitation. Various other embodiments and variants are possible within the spirit and scope of the present invention.

What is claimed is:

1. A coating method in a coating line for coating separately first and second substrates of materials having different coating characteristics with paint to form highly reflective surface coatings on the substrates with substantially consistent gloss characteristics and assembling the substrates into integral bodies, comprising:

a spraying step for spraying the paint on each of the first and second substrates to form a coat on each of the substrates;

a drying step for drying the coat on each of the substrates; and one or more steps for assembling the coated first and second substrates into integral bodies of substantially consistent gloss characteristics;

wherein the paint is sprayed in the spraying step in a film thickness which is thicker than a thickness at which the paint sags on a surface extending at least upwardly and downwardly; and the coat on each of the substrates is dried in the drying step while each of the substrates is rotated about its horizontal axis for a period of time ranging from at least before the paint starts sagging until the paint achieves a substantially sagless state, the rotation of the substrates being carried out at speeds which are high enough to rotate the substrates from a vertical position to a horizontal position before the paint coated thereon sags due to gravity yet which are low enough so as to cause substantially no sagging as a result of centrifugal force.

2. A coating method as claimed in claim 1, wherein the drying step for drying the first substrate comprises setting and baking steps in which the first substrate is held in an ambient temperature during the setting step which is lower than the ambient temperature during the baking step.

3. A coating method as claimed in claim 1, wherein the drying step for drying the first substrate comprises only the baking step.

4. A coating method as claimed in claim 1, wherein the drying step for drying the second substrate comprises setting and baking steps in which the second substrate is held in an ambient temperature during the setting step which is lower than the ambient temperature during the baking step.

5. A coating method as claimed in claim 1, wherein the drying step for drying the first and second substrates comprises setting and baking steps in which the first and second substrates are held in an ambient temperature during the setting step which is lower than the ambient temperature during the baking step.

6. A coating method as claimed in claim 1, wherein the drying step for drying the first substrate comprises only the baking step; and the drying step for drying the second substrate comprises setting and baking steps in which the second substrate is held in an ambient temperature during the setting step which is lower than the ambient temperature during the baking step.

7. A coating method as claimed in claim 1, wherein the paint to be sprayed on the first substrate is a paint containing a volatile solvent.

8. A coating method as claimed in claim 1, wherein the paint ot be sprayed on the first substrate does not contain a volatile solvent.

9. A coating method as claimed in claim 1, wherein the paint to be sprayed on the first substrate is a twoliquid reactive type paint containing a main resin and a curing agent.

10. A coating method as claimed in claim 1, wherein the paint to be sprayed on the first substrate is a powder paint.

11. A coating method as claimed in claim 1, wherein the paint to be sprayed on the second substrate is a urethane paint.

12. A coating method as claimed in claim 1, wherein:

at least either of the drying step drying the first step or the drying step for drying the second step comprises a setting step and a baking step in which the substrate is held in an ambient temperature which is higher than the ambient temperature during the setting step;

the paint to be sprayed on the first substrate or the second substrate is a paint that can cause sagging during the setting step and the baking step unless it is left treated; and the first substrate or the second substrate sprayed with the paint is rotated about its substantially horizontal axis during the setting step and the drying step.

13. A coating method as claimed in claim 1, wherein:

at least either of the drying step for drying the first step or the drying step for drying the second step comprises a setting step and a baking step in which the substrate is held in an ambient temperature which is higher than the ambient temperature during the setting step;

the paint to be sprayed on the first substrate or the second substrate is a paint that can cause sagging during either of the setting step or the baking step unless it is left treated; and the first substrate or the second substrate sprayed with the paint is rotated about its substantially horizontal axis only during either of the setting step or the drying step during which the paint causes sagging.

14. A coating method as claimed in claim 1, wherein a material for the first substrate has a thermally resistant temperature different from a material for the second substrate.

15. A coating method as claimed in claim 14, wherein the material for the first substrate has a thermally resistance temperature higher than the material for the second substrate.

16. A coating method as claimed in claim 1, wherein:
a material for the first substrate is a metal; and a material for the second substrate is a plastic.

17. A coating method as claimed in claim 16, wherein the material for the first substrate is an iron metal.

18. A coating method as claimed in claim 16, wherein the material for the second substrate is a urethane-type plastic.

19. A coating method as claimed in claim 16, wherein:
the material for the first substrate is an iron metal; and
the material for the second substrate is a urethane-type plastic.

20. A coating method as claimed in claim 16, wherein:
the paint to be sprayed on the first substrate is a thermosetting paint of the type being diluted with a solvent, a tow-liquid reactive type paint or a powder; and
the paint to be sprayed on the second substrate is a one-liquid urethane paint or a two-liquid urethane paint.

21. A coating method as claimed in claim 19, wherein:
the paint to be sprayed on the first substrate is a thermosetting paint of the type being diluted with a solvent, a two-liquid reactive type paint or a powder; and
the paint to be sprayed on the second substrate is a one-liquid urethane paint or a two-liquid urethane paint.

22. A coating method as claimed in claim 19, wherein:
the first substrate is a vehicle body; and
the second substrate is a part to be mounted to the vehicle body.

23. A coating method as claimed in claim 22, wherein the part is made of a plastic.

24. A coating method as claimed in claim 22, wherein the part is a bumper.

25. A coating method as claimed in claim 24, wherein the bumper is made of a urethane-type plastic.

26. A coating method as claimed in claim 22, wherein the body is made of a ferrous metal.

27. A coating method as claimed in claim 22, wherein the part is made of a urethane-type plastic.

28. A coating method as claimed in claim 22, wherein:
the body is made of a ferrous metal; and
the part is made of a urethane-type plastic.

29. A coating method as claimed in claim 22, wherein:
the paint to be sprayed on the vehicle body is a thermosetting paint of the type being diluted with a solvent, a two-liquid reactive type paint or a powder; and
the paint to be sprayed on the part is a one-liquid urethane paint or a two-liquid urethane paint.

30. A coating method as claimed in claim 1, wherein the rotational axis of the first substrate and the second substrate coincides substantially with the gravitational center of the first substrate and the second substrate.

31. A coating method as claimed in claim 1, wherein the paint is sprayed twice on the first substrate and/or the second substrate in such a manner that a total film thickness of first and second coats thereon amounts to a given film thickness.

32. A coating method as claimed in claim 1, wherein the first substrate and/or the second substrate are/is rotated in one direction.

33. A coating method as claimed in claim 1, wherein the first substrate and/or the second substrate are/is rotated continuously.

34. A coating method as claimed in claim 1, wherein the first substrate and/or the second substrate are/is rotated intermittently.

35. A coating method as claimed in claim 1, wherein the first substrate and/or the second substrate are/is rotated first in one direction and then in the opposite direction.

36. A coating method as claimed in claim 1, wherein the first substrate and/or the second substrate are/is rotated at a speed of 380cm per second or lower as measured at a radially outward tip portion of the first substrate and/or the second substrate.

* * * * *